US008107798B2

(12) United States Patent
Shapiro et al.

(10) Patent No.: US 8,107,798 B2
(45) Date of Patent: Jan. 31, 2012

(54) CONSOLE ELECTRIC HEATER WITH PLENUM

(75) Inventors: Barry Shapiro, Doylestown, PA (US); Paul W. Orr, Coatesville, PA (US); Robert L. Boohar, Gap, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 777 days.

(21) Appl. No.: 12/248,164

(22) Filed: Oct. 9, 2008

(65) Prior Publication Data

US 2009/0148141 A1 Jun. 11, 2009

Related U.S. Application Data

(63) Continuation of application No. 11/344,921, filed on Feb. 1, 2006, now abandoned.

(60) Provisional application No. 60/652,334, filed on Feb. 11, 2005.

(51) Int. Cl.
*F24D 15/02* (2006.01)
*F24D 1/04* (2006.01)

(52) U.S. Cl. ..... 392/367; 392/347; 392/365; 392/366

(58) Field of Classification Search ..... 392/347, 392/351, 355, 356, 360, 365, 367, 366, 368, 392/369, 379, 382, 383; 219/476, 477, 478, 219/505

See application file for complete search history.

(56) References Cited

U.S. PATENT DOCUMENTS

| | | | |
|---|---|---|---|
| 2,375,920 | A | 5/1945 | Hewitt |
| 2,481,963 | A | 9/1949 | Witte et al. |
| 2,759,411 | A | 8/1956 | Jensen |
| 2,762,886 | A | 9/1956 | Visos |
| 3,059,090 | A | 10/1962 | Waters |
| 3,250,457 | A | 5/1966 | Walker |
| 3,251,540 | A | 5/1966 | Kinsworthy |
| 4,307,284 | A | 12/1981 | Perron |
| 4,520,864 | A | 6/1985 | Katagin et al. |
| 4,743,737 | A | 5/1988 | Tateishi |
| 5,197,112 | A | 3/1993 | Cameron |
| 5,488,218 | A | 1/1996 | Olsen et al. |
| 6,167,193 | A | 12/2000 | Birdsell et al. |
| 6,480,672 | B1 | 11/2002 | Rosenzweig et al. |
| 6,795,643 | B2 | 9/2004 | Ito et al. |

FOREIGN PATENT DOCUMENTS

EP 190966 A1 8/1986

*Primary Examiner* — Thor Campbell

(74) *Attorney, Agent, or Firm* — Pepper Hamilton LLP

(57) ABSTRACT

A portable electric heater possessing characteristics similar to a portable electric oil filled heater absent the use oil and its associated manufacturing and environmental problems. The device includes an electric heater, a rotatable plenum and an external housing providing space saving characteristics.

19 Claims, 9 Drawing Sheets

CONSOLE ELECTRIC HEATER WITH PLENUM

CROSS-REFERENCE TO RELATED APPLICATIONS

This application is a Continuation of U.S. application Ser. No. 11/344,921 filed Feb. 1, 2006, which claims the benefit of U.S. Provisional Application No. 60/652,334 filed Feb. 11, 2005.

TECHNOLOGY FIELD

The present invention relates to portable electric room heaters.

BACKGROUND

Portable electric heaters have existed for many years. For example, conventional heaters that use oil as a heat dispersion media maintain a consistent heat which in turn helps maintains a stable and consistent room temperature. Another advantage of oil filled heaters is that the functional design is easily adaptable to an accepted look normally associated with existing hot water radiators used on central heat systems.

Conventional heaters have several disadvantages as well. One disadvantage of oil filled heaters is that they radiate heat in all directions from the unit. The radiation of heat in all directions precludes the possibility that the heater can be placed in close proximity to a wall of a room or other objects such as for example furniture. The inability to place the heater next to a wall or other objects in the room severely reduces it's space saving characteristics.

There are also several manufacturing problems associated with portable oil filled heaters. The ability to contain the oil within the structure of the heater requires additional manufacturing expense and care be exerted to insure that all connections and seams between the various parts of the heater be "liquid tight". Seams and fittings of existing oil filled heaters require welding during fabrication. The need to weld the fittings and seams require the manufacturer to invert capital into the design and purchase of specialized equipment.

Additionally oil filled heaters may develop a leak during the course of it's expected lifetime. Escaping oil will leak onto surrounding objects and surfaces, such as for example furniture, floor coverings, etc. The possibility of leakage not only creates additional financial liabilities for the manufacturer, (being required to cover the expense of such damage) it also contributes to a poor customer experience and the loss of future sales for the manufacturer.

Oil leaks may also pose an environmental hazard for the user. Regardless of possible accidental leakage, at the end of it's expected life the conventional oil filled heater, including the oil will need to be disposed of properly. This disposal may cause unexpected expense for the user and unwanted liability for the manufacturer.

Portable electric baseboard heaters are constructed to discharge heat close to floor. Normally the air inlet and the heated air outlet are located relatively close to one another. The lack of elevation inherent with a conventional electric baseboard heater decreases the ability of device to distribute the heated air effectively. The relatively close proximity of the air inlet to the heated air outlet increases the recirculation of heated air directly into the air inlet thus further decreasing the effective distribution of heated air into a room.

SUMMARY

In view of the deficiencies of the prior art the following description is of a portable electric heater that overcomes several if not all of the prior art deficiencies. The portable heater as described posses the ability to be placed near a wall or furniture in a room, enhancing it's space saving characteristics. The present invention does not use oil or other liquids thus removing the possible problems associated with oil leakage. The elimination of the leakage problems would ideally allow the manufacturer to produce the device at a lower cost. The lower cost will enhance the appeal of the device to a greater number of users. The portable electric heater as described also has an elevated heated air outlet thus overcoming deficiencies found in the conventional electric baseboard heater.

According to one aspect of the invention, the portable electric heater includes a stand alone housing having a rear, a top, and a bottom. The rear of the housing is a substantially planar surface oriented substantially vertical.

According to another aspect of the invention, an air inlet is located in the housing allowing air to enter the housing and an air outlet is located in an upper portion of the housing allowing air to exit the housing.

According to another aspect of the invention, the air outlet faces a forward direction between an upper limit and a lower limit;

According to yet another aspect of the invention, a blower is disposed within the housing generating an exhaust air stream.

According to another aspect of the invention, an electric heating element is disposed in the housing and a heated exhaust air stream is formed by heating the exhaust air stream with the electric heating element.

According to another aspect of the invention, a heated exhaust air stream exits the housing through the air outlet and is directed in a substantially forward direction between the upper limit and the lower limit.

According to another aspect of the invention, The direction of discharge of the heated exhaust air stream is limited to substantially parallel to and/or angled away from the substantially planar rear surface of the housing thus allowing the substantially planar rear surface of the housing to be placed adjacent substantially vertically oriented objects without directly impinging the heated exhaust air stream on the substantially vertically oriented objects.

According to another aspect of the invention, the angular direction of discharge of the heated exhaust air stream is adjustable between the upper limit and the lower limit.

According to yet another aspect of the invention, a curved surface is formed at an upper end of the housing between the front and the top of the housing and the air outlet is in the curved surface and the direction of discharge of the heated exhaust air stream is forward and adjustable between the upper limit and the lower limit.

According to another aspect of the invention, the housing has an overall height, an overall width, and an overall depth and the overall depth is less than either the overall height and/or the overall width.

According to another aspect of the invention, a foot-print for the portable electric heater is defined by the overall width and the overall depth and the portable electric heater is adapted to be placed with the substantially planar rear surface of the housing adjacent vertically oriented object thus providing space savings characteristics for the portable electric heater.

According to another aspect of the invention, an overall form factor is defined by the overall height being at least about three times the overall depth, and the overall width being at least two times the overall depth.

According to another aspect of the invention, an exit elevation of the heated exhaust air stream above a support surface is greater than about 18 inches.

According to another aspect of the invention, the portable electric heater includes an outlet grill located completely in an upper portion of the housing proximate the air outlet.

According to another aspect of the invention, a first interior space is defined by the housing and a heater assembly is disposed within the first interior space and includes: at least one entry port, at least one exit port, a motor, at least one air impeller, a rotatable plenum in fluid communication with the exit port, a second interior space defined by the rotatable plenum, at least one hot air exit allowing air to exit the second interior space, a substantially horizontal axis of rotation about which the rotatable plenum rotates, at least one electric heating element located between the impeller and the hot air exit.

According to yet another aspect of the invention, the angular direction of discharge of the heated exhaust air stream is always in a forward direction and is adjustable vertically up and down as the rotatable plenum rotates between an upper and a lower limit.

According to another aspect of the invention, the motor is substantially stationary during a rotation of the rotatable plenum and a transfer duct is located between the air impeller and the rotatable plenum.

According to another aspect of the invention, the motor moves in conjunction with the rotatable plenum during a rotation of the rotatable plenum.

According to another aspect of the invention, a predetermined angular range of the direction of discharge of the heated exhaust air stream is limited between the upper limit and the lower limit of rotation of the rotatable plenum and the predetermined angular range is about 180 degrees or less.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION OF ILLUSTRATIVE EMBODIMENTS

The following is a description of an exemplary portable heater utilizing and electric heating element. The use of electronics to control the heating element and/or the speed of the impeller can be used to provide a viable and stable heat output from the portable heater. The ability to sonically insulate the blower assembly enhances the low noise characteristics of the portable electric heater.

The portable electric heater to improves upon the desirable performance characteristics of conventional portable oil filled heaters while avoiding the manufacturing and environmental problems associated conventional portable oil filled heaters. For example, the portable electric heater does not use oil or other liquids thus removing the possible problems associated with oil leakage. The ability to control and direct the heated exhaust air flow exiting the portable heater also overcomes the heat radiation and space requirement problems associated with many conventional portable oil filled heaters.

Figure 1:
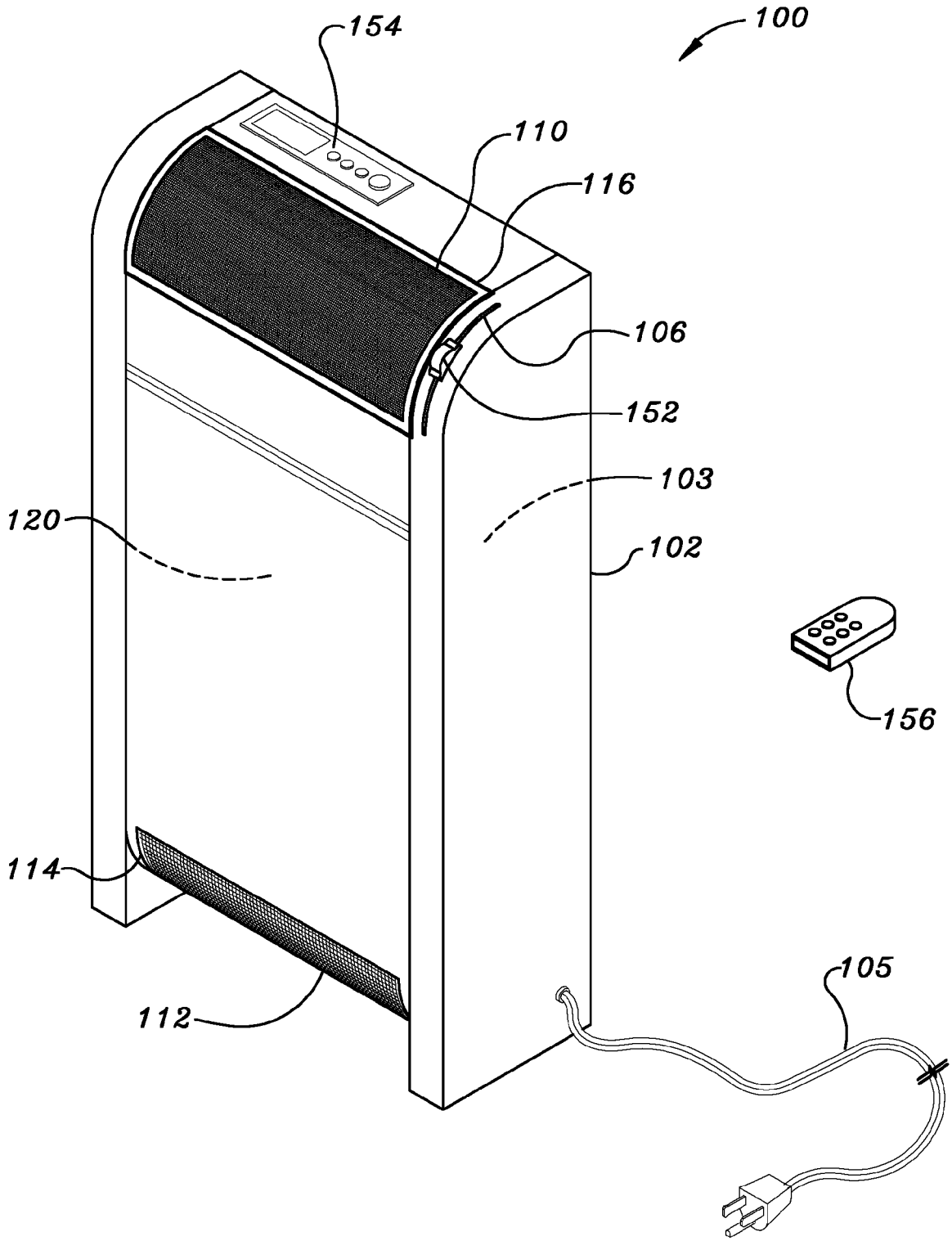
FIG. 1 is a front perspective view of an exemplary portable electric heater.

FIG. 1 is a front perspective view of an exemplary portable electric heater 100. Housing 102 includes an air inlet 114, an air outlet 116. Housing 102 defines first interior space 103. In the embodiment shown, air inlet 114 is located in the lower, front portion of housing 102, but the invention is not so limited. It is contemplated that air inlet 114 could be located on the sides, front, bottom and/or rear of a lower portion of housing 102.

Inlet grill 112 is located proximate air inlet 114 and outlet grill 110 is located proximate air outlet 116.

Heater assembly 120 is disposed within first interior space 103. Heater assembly 120 includes a blower that is utilized to draw ambient air into housing 102 via air inlet 114 and generates a heated exhaust air stream that exits housing 102 via air outlet 116.

Also shown in FIG. 1 is control assembly 154. Control assembly 154 may be attached to an external surface such as, for example near an upper end of housing 102. The position of the control assembly 154 as shown benefits the user in that the height of the control assembly 154 above a support surface (floor) allows convenient accessibility for visual inspection and manual adjustment. Alternatively, control assembly 154 may be located near a lower end of housing 102 and supplied with a foot controlled interface, (not shown). Alternatively, control of portable electric heater 100 may be accomplished by a remote control unit 156 in conjunction with or as a replacement for control assembly 154. Control assembly 154 controls one or more functions of portable electric heater 100, such as for example, power on/off, the power settings of heater assembly 120, etc. Control assembly 154 may include such devices as switches, thermostats, timers, printed circuit boards, LEDs, computer chips, and the like.

Also shown is power cord 105, utilized to connect portable electric heater 100 to an electrical power source (i.e. wall outlet). The electrical component connections of portable electric heater 100 are integrated within the device, such as for example between control assembly 154 and heater assembly 110. The integration of the electrical component connections within portable electric heater 100 eliminates the need for the user to make such connections. In the exemplary embodiment shown, for example only the connection of power cord 105 to an electrical power source is required. The integration of the electrical component connections within the device also enhance the portability of portable electric heater 100.

Preferably, the portable electric heater includes a mechanism for directing the heated exhaust air to a desired location. In the embodiment shown in FIG. 1, for example, slot 106 is used in conjunction with slide 152 to allow the user to change the angular direction (i.e., elevation up and down) of the heated exhaust air stream. In addition, the air directing mechanism can also include a device for adjusting the heated exhaust air from side to side, as well as, up and down.

Figure 2:
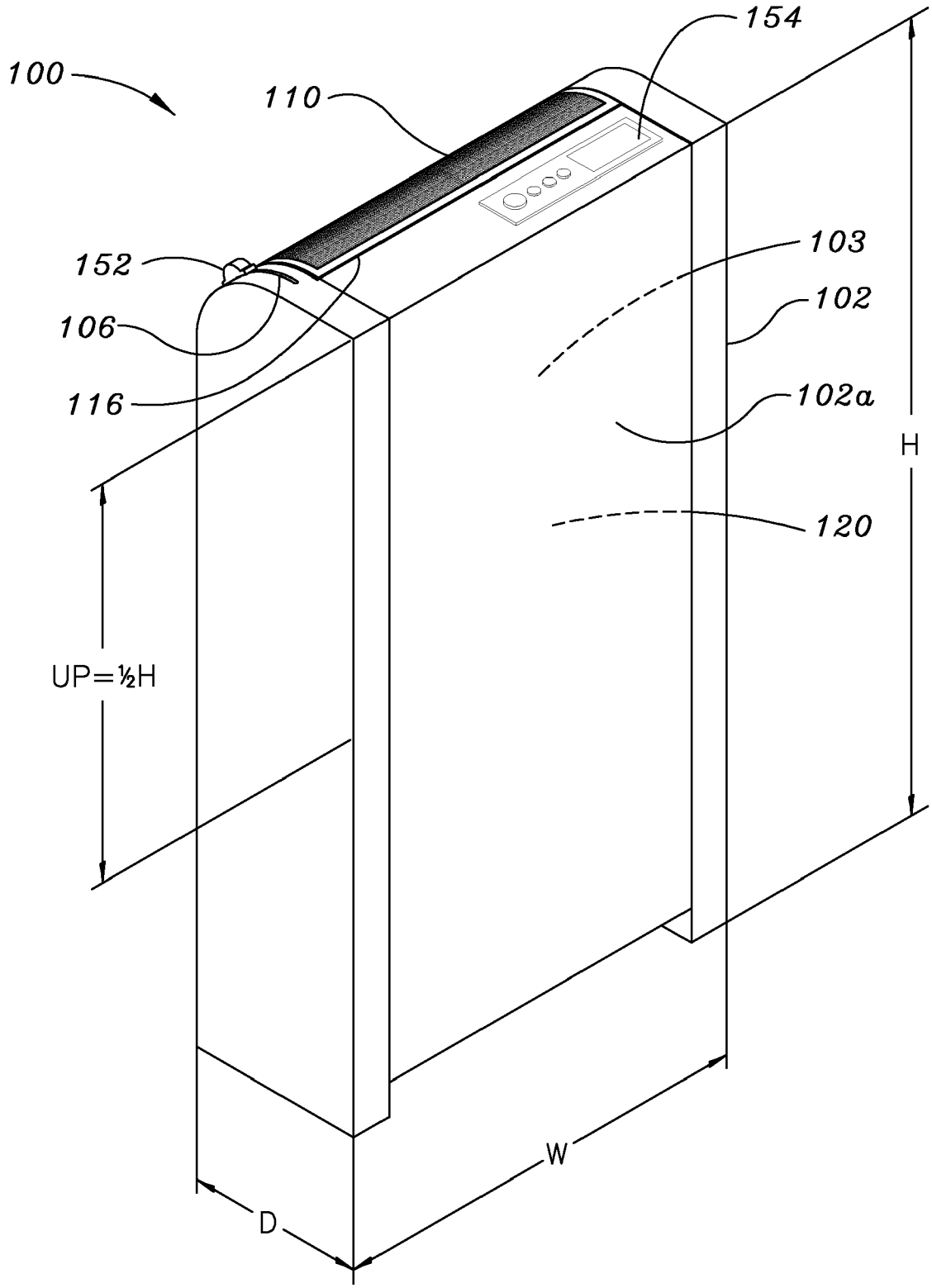
FIG. 2 is a rear perspective view of the portable electric heater of FIG. 1.

FIG. 2 is a rear perspective view of the portable electric heater 100 of FIG. 1. Shown is rear side 102*a* of housing 102. Rear side 102*a* of housing 102 as shown is substantially flat and planar and is oriented substantially orthogonal to a support surface (floor). The substantially flat surface of rear side 102*a* of housing 102 allows portable electric heater to be located proximate other objects such as, for example, furniture, walls and other appliances.

Also shown in FIG. 2 are overall height "H" of housing 102, overall width "W" of housing 102 and overall depth "D" of housing 102. As can be seen, overall depth "D" is less than either overall height "H" or overall width "W". This limitation of overall depth "D" improves the space saving characteristics of electric heater 100 when located proximate other objects such as for example, furniture, walls and other appliances.

The limitation of overall depth "D" minimizes the footprint of portable electric heater 100 as it protrudes away from a wall into the room. Overall width "W" and overall height "H" are not so limited in that they are parallel to the surface of the wall and do not adversely effect the floor space occupied by portable electric heater 100 as readily as overall depth "D".

Overall height "H" is used to facilitate the elevation of air outlet 116 thereby increasing the discharge height of the heated exhaust air stream. Increasing the discharge height of the heated exhaust air stream enhances the circular, or cyclonic air flow within a room. As shown air outlet 116 is located substantially within an upper portion "UP" of housing 102. Upper portion "UP" of housing 102 is defined as the upper one half of overall height "H". Locating air outlet 116 within upper portion "UP" reduces the recirculation of heated air into air inlet 114. It is contemplated that leg extensions (not shown) could be used to further increase overall height "H" absent the need to increase the size of housing 102.

Increasing overall width "W" enhances the stability of electric heater 100 by creating a wider "base." Stability is also enhanced by the additional mass that is added to electric heater 100 in conjunction with increasing overall width "W." In one embodiment, overall height "H" is greater than about three times overall depth "D" and overall width "W" is greater than about two times overall depth "D." In another embodiment, overall depth "D" is less than about 8 inches. In yet another embodiment, overall width "W" is greater than about 12 inches and overall height "H" is greater than about 18 inches.

Figure 4:
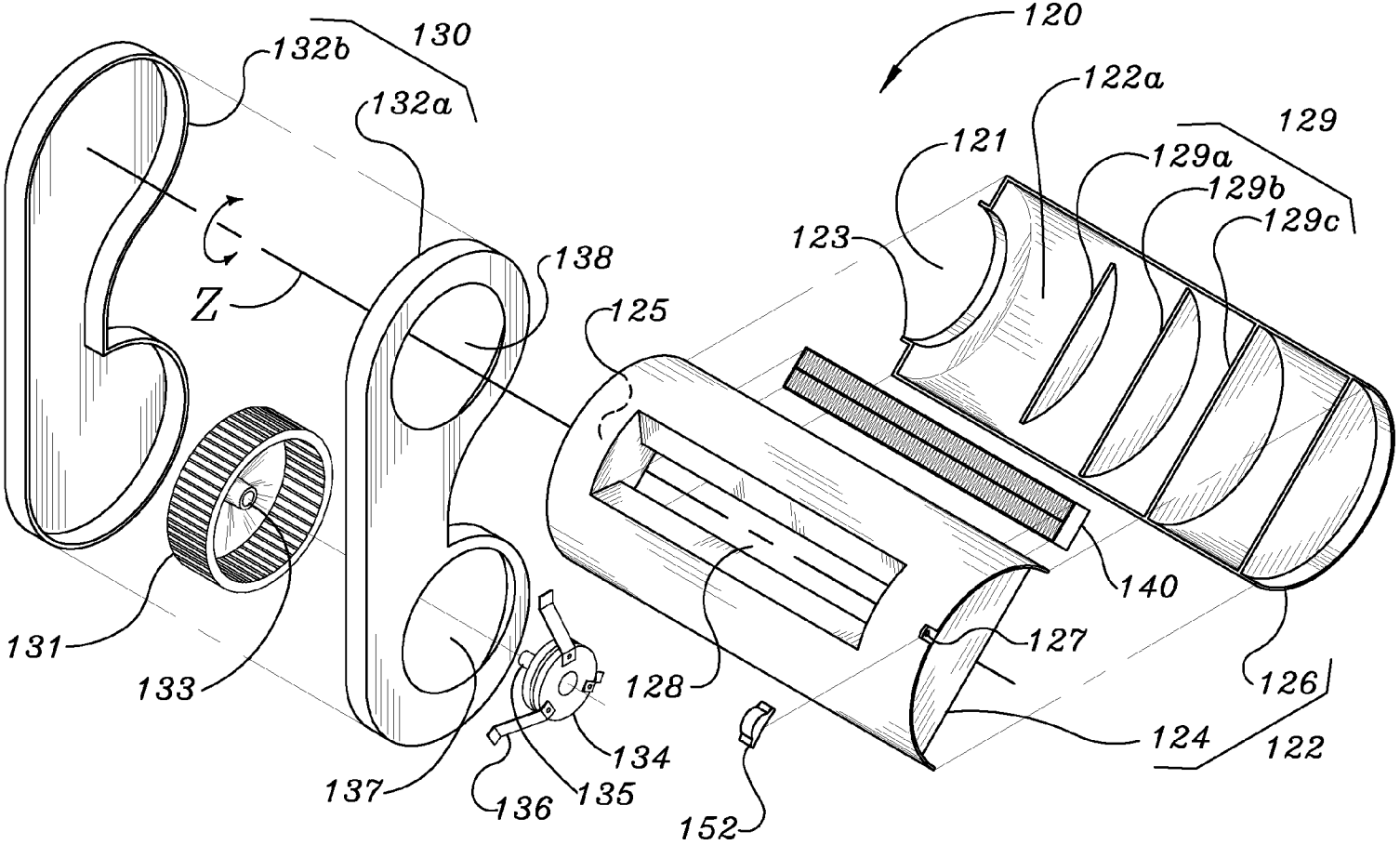
FIG. 4 is an exploded view of an exemplary embodiment of the heater assembly.
Figure 5:
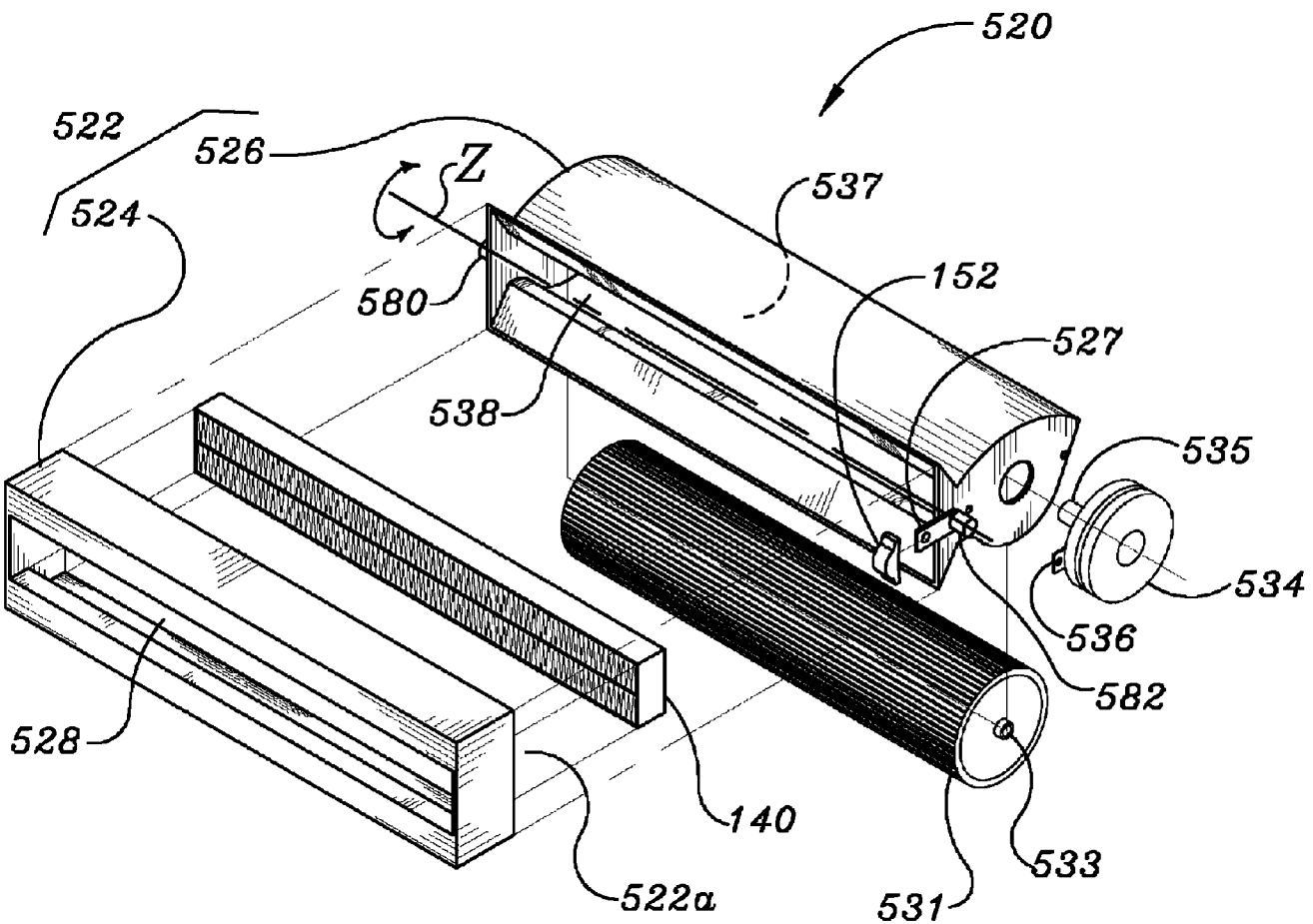
FIG. 5 is an exploded view of another exemplary embodiment of the heater assembly.

In addition to enhancing stability overall width "W" also serves to accommodate the horizontal aspect ratio of the heating element, (see FIGS. 4 and 5). The horizontal aspect ratio of the heating element generates a horizontally wide heated exhaust air flow. The width of heated exhaust air flow enhances the ability of portable electric heater 100 to distribute the heat evenly throughout a room.

Figure 3:
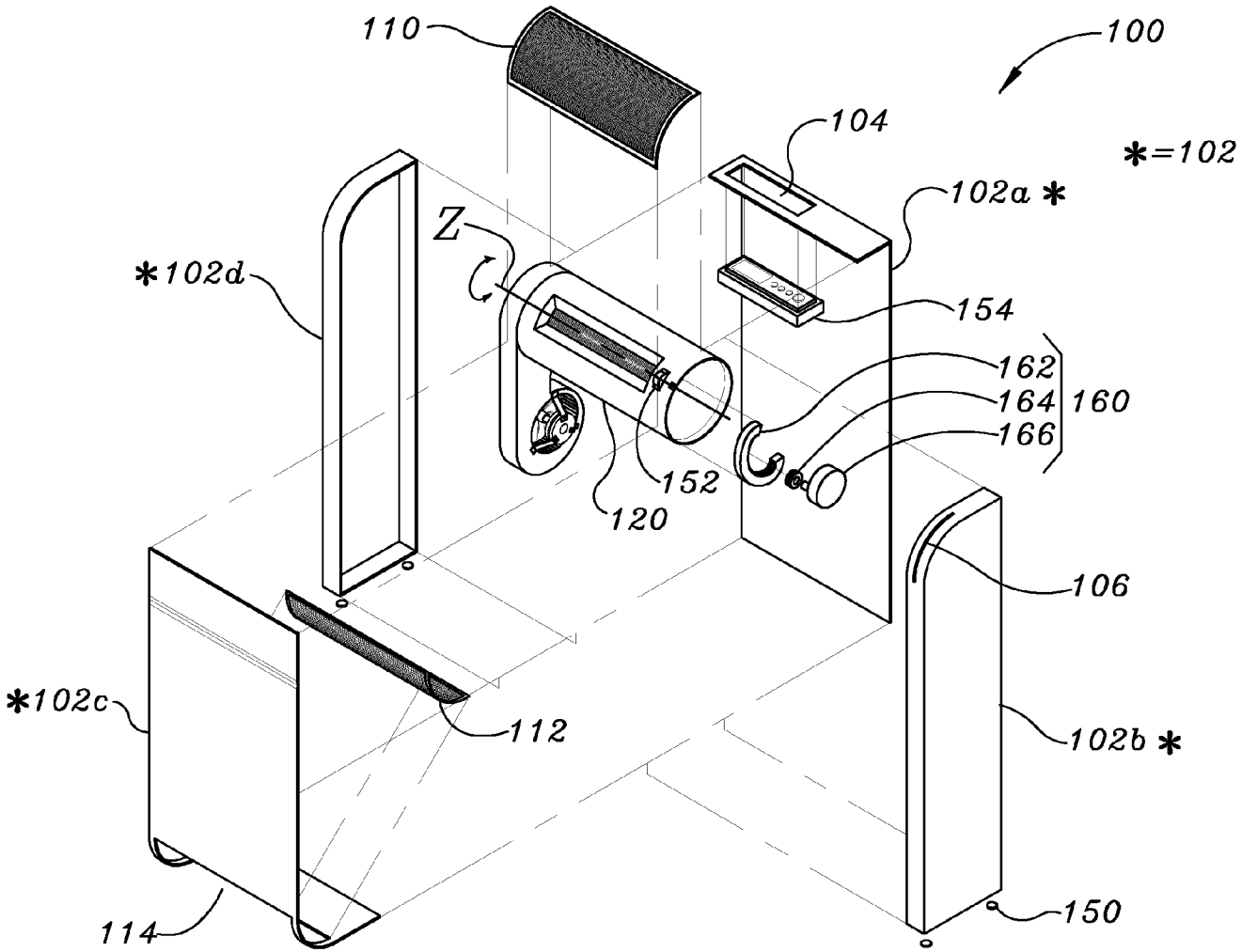
FIG. 3 is an exploded view of the portable electric heater of FIG. 1.

FIG. 3 is an exploded perspective view of portable electric heater 100. As shown, heater assembly 120 is located within first interior space 103 of housing 102. Heater assembly 120 may be held in position using brackets (not shown) and/or other assembly structures and fasteners commonly known by one skilled in the art. Although heater assembly 120 is shown in an assembled form it is not so limited. It is contemplated that the components of heater assembly 120, (see FIGS. 4 and 5) may be assembled separately within housing 102 without departing from the spirit of the invention. It should be noted that the use of heater assembly 120 as a sub-assembly may have cost and manufacturing advantages when compared to assembling the component of heater assembly 120 separately within housing 102.

As shown in this example, housing 102 is constructed of four different components, rear side 102*a*, right side 102*b*, front side 102*c* and left side 102*d*. Housing 102 may be constructed of metal or polymer and assembled together via brackets, screws and/or other assembly structures and fasteners commonly known by one skilled in the art. In one embodiment, exterior housing 102 is formed of metal which enhances the weight characteristics and therefore the value associated with portable electric heater 100. Preferably, housing 102 is formed of polymer thereby enhancing the electrical safety of portable electric heater 100 when compared to a metal housing.

Control assembly 154 is attached as shown through control opening 104. Control opening 104 allows control assembly 154 to access the area outside portable heater 100 and inside housing 102. Access to the inside of housing 102 by control assembly 154 allows all the electrical component connections of portable electric heater 100 to be integrated within the device while yet allowing the user full access to the control of portable electric heater 100.

Inlet grill 112 is located proximate air inlet 114. As shown air inlet 114 is located in front side wall 102*c*. Inlet grill 112 may be constructed from a unitary piece, as shown or from multiple components. Inlet grill 112 allows room air to be drawn through air inlet 114 into housing 102 of portable electric heater 100 by heater assembly 120. Inlet grill 112 allows room air to enter while protecting the interior of housing 102 from the intrusion of foreign object and consequent damage. Inlet grill 112 includes a surface providing a series of openings that can be in the form of round holes, square holes, slots or other various shapes. Inlet grill 112 may be formed of polymer and/or metal.

Outlet grill 110 is located proximate the air outlet 116. As shown in the present example, the air outlet 116 is defined as the opening that is formed when rear side 102*a*, right side 102*b*, front side 102*c* and left side 102*d* are assembled as housing 102. Outlet grill 110 may be constructed from a unitary piece, as shown, or from multiple components. Outlet grill 110 allows the heated exhaust air stream generated by heater assembly 120 to exit portable electric heater 100 through air outlet 116 while protecting the interior of housing 102 from the intrusion of foreign object and consequent damage. Outlet grill 110 includes a surface providing a series of openings that can be in the form of round holes, square holes, slots or other various shapes. Outlet grill 110 may be formed of polymer and/or metal.

As shown air outlet 116 and outlet grill 110 have a curved surface. The curved surface enhances the ability to expel a heated exhaust air stream at an angle relative to housing 102. As can be appreciated this feature is useful in an embodiment of portable electric heater 100 in which the angular direction of discharge of the heated exhaust air stream is adjustable. Although air outlet 116 and outlet grill 110 have curved forms the invention is not so limited. It is contemplated that a flat surface located on an angle could be used. The angled flat surface would also serve to enhances the ability to expel a heated exhaust air stream at an angle relative to housing 102, similar to the curved surface.

It is contemplated that filters, (not shown) could be placed between inlet grill 112 and outlet grill 110 for the purpose of air filtration. Filters will enhance the use of portable electric heater for use as a portable air filtration system as well as protecting heater assembly 120 from dust and debris.

Also shown in FIG. 3 are feet 150. Feet 150 in this example consist of four pads that connect to housing 102. It is contemplated that two or more wheels may be used in lieu of feet 150, for example see FIG. 6A.

Slot 106 allows stem 127 of heater assembly 120 to be exposed exterior to housing 102, specifically through right side 102*b*. Stem 127 is used in conjunction with slide 152 to rotate a portion of heater assembly 120 about axis of rotation "Z" allowing the user to change the direction of the heated exhaust air stream. It is contemplated that other mechanisms in lieu of stem 127 may be incorporated to adjusting the direction of the heated exhaust air stream. For example, an extension knob located substantially concentric with axis of rotation "Z" and extending through side wall 102*b*. Such mechanisms are not considered as departing from the spirit of the invention. Also shown is oscillation mechanism 160. Oscillation mechanism 160 includes gear segment 162, pinion gear 164 and oscillation motor 166. It is contemplated that other oscillation mechanisms such as link and pivot, slot and pin and the like may be used.

FIG. 4 is an exploded view of another exemplary embodiment of heater assembly 120 of portable electric heater 100. Motor 134 is connected to air transfer duct assembly 130 utilizing bracket 136. Impeller 131 is connected to motor 134 via socket 133 of impeller 131 and motor shaft 135. Impeller 131 is located inside air transfer duct assembly 130 which includes, in this example first side 132*a* and second side 132*b*. First side 132*a* includes entry port 137 and first air passageway 138. In the exemplary embodiment impeller 131 is a centrifugal type impeller, the invention however is not so limited. It is contemplated that other impellers, such as for example, a cross flow impellers may be used without departing from the spirit of the invention.

Rotatable plenum 122 is constructed of front portion 124 and rear portion 126. Rotatable plenum 122 defines second interior space 122*a*. Heating element 140 is located in second interior space 122*a* proximate hot air exit 128 located, in this example, in front portion 124. It is contemplated that heating element 140 may be located anywhere between impeller 131 and hot air exit 128. As shown in FIG. 4, locating heating element 140 proximate hot air exit 128 permits the heated air to be expelled immediately from first interior space 103 of housing 102, (see also FIG. 1). The immediate expulsion of the heated air from housing 102 reduces heat build up within first interior space 103 and eliminates the need for additional thermal insulation within housing 102.

As shown second air passageway 121 is formed at an axial end of rotatable plenum 122 and is defined, in this example by collar 123 and collar 125 of rear portion 126 and front portion 124, respectively. Rotatable plenum 122 is rotatably connected to air transfer duct assembly 130 via collars 123, 125 and is in fluid communication with first air passageway 138.

Although many types of heating elements 140 may be used, such as for example; hot wire or calrod radiator, the non-limiting example shown utilizes Positive Temperature Coefficient (PTC) technology for heating element 140. The use of a PTC heating element 140 assures a self-regulating low surface temperature of approximately 450 degrees Fahrenheit (232 degrees Celsius).

It is contemplated that a PTC type heating element 140 with self regulating temperature characteristic used in conjunction with electronic controls will enhance the ability to maintain a substantially stable room temperature. The use of thermostats and/or other temperature sensing devices may be used in conjunction with the electronic controls to monitor the room temperature and subsequently adjust the output of the device by, for example, adjusting the rotational speed of motor 134. The self regulating characteristic of heating element 140 will naturally lower or raise the power required by heating element 140 as the quantity of air produced by the rotation of impeller 131 increases or decreases. The control of the rotational speed of motor 134 will avoid the on/off cycle associated with conventional portable forced hot air devices. The absence of the on/off cycle will avoid unwanted temperature drops and rises. As can be appreciated, this will contribute to a consistent heat output based on the room temperature, enhancing the overall comfort of the user. In addition the on/off cycle of conventional portable forced hot air devices can be distractive to the user.

The ability to control the power consumption of heating element 140 and the heat output from portable electric heater 100 through the preferred adjustment of the rotational speed of motor 134 has cost advantages when compared to controlling the actual power distribution supply of heating element 140. The electronic components, such as for example switches, relays, regulators and power control board circuitry are not required to carry the high amperage load of heating element 140. The electronic components will only need to carry the lower amperage load of motor 134. In one embodiment heating element 140 has a maximum normal operational load of 12 to 13 amps while motor 134 has a maximum normal operational load of less than 0.5 amp. In general, carrying a lower amperage will decrease the cost of such electronic components.

As shown, heating element 140 has a horizontal aspect ratio defined by it's horizontal longitudinal length being greater than it's height. In one exemplary embodiment, the horizontal aspect ratio of electric heating element 140 is greater than about 2 to 1. More preferably, electric heating element 140 has a horizontal aspect ratio of greater than about 4 to 1.

The horizontal aspect ratio of electric heating element 140 generates a horizontally wide heated exhaust air flow. The horizontal width of the heated exhaust air flow augments the horizontal coverage area of the heated exhaust air flow produced by portable electric heater 100 thus reducing the need and therefore the complication of oscillation mechanisms found in many conventional portable forced hot air devices. The width of heated exhaust air flow also enhances the ability of portable electric heater 100 to distribute the heat evenly throughout a room.

Ambient air is drawn into transfer duct assembly 130 via entry port 137 by a rotation of impeller 131. Impeller 131 accelerates the ambient air and generates an exhaust air stream which exits transfer duct assembly 130 through first air passageway 138 and enters second interior space 122*a* of rotatable plenum 122 through passageway 121. The space between first air passageway 138 and hot air exit 128, which in this embodiment includes second interior space 122*a* of rotatable plenum 122 is charged with a positive static pressure causing the exhaust air stream to flow through substantially all of heating element 140. Thermal energy (heat) is transferred to substantially all of the exhaust air stream as it flows through heating element 140, thus becoming a heated exhaust air stream.

Rotatable Plenum 122 is utilized to distribute the exhaust air stream generated by impeller 131 across the horizontal length of heating element 140. Also shown is air directing component 129 disposed in second interior space 122*a*. As shown, air directing component 129 includes vertical walls 129*a*, 129*b*, and 129*c*. As the exhaust air stream travels along the horizontal length of plenum 122 vertical walls 129*a*, 129*b* and 129*c* redirect the exhaust air flow toward heating element 140. As can be seen vertical walls 129*a*, 129*b* and 129*c* extend into plenum 122 at different locations along the horizontal length of plenum 122. Vertical walls 129*a*, 129*b* and 129*c* also have varied length as they extend into plenum 122. The different locations and the varied lengths of vertical walls 129*a*,

129*b* and 129*c* help distribute the flow of the exhaust air stream more evenly across the horizontal length of heating element 140. The normal flow of the exhaust air stream absent vertical walls 129*a*, 129*b* and 129*c* would force the majority the exhaust air stream to exit heating element 140 at the end opposite second air passageway 121 of plenum 122.

Air directing component 129 may be unitary with plenum 122 or a separate part attached to plenum 122. It is also contemplated that other forms such as curved walls may be used in lieu of vertical walls 129*a*, 129*b*, and 129*c*. Although air directing component 129 is shown attached to rear portion 126 of plenum 122 the invention is not so limited. It is contemplated that air directing component 129 could be attached to elsewhere, such as for example front portion 124.

As shown, stem 127 is connected to rotatable plenum 122 of heater assembly 120. Stem 127 passes through slot 106 to be exposed exterior to housing 102. Slide 152 is connected to stem 127 and is utilized by the user of portable electric heater 100 to rotate rotatable plenum 122 about axis of rotation "Z". The rotatable movement of rotatable plenum 122 allows the user to change the vertical angular direction of the heated exhaust air stream.

The use of air transfer duct 130 allows motor 134 and impeller 131 to be located farther inside housing 102 (see FIG. 3) of portable electric heater 100 and away from air inlet 114 and outlet grill 110. This location within housing 102 enhances the ability to sonically isolate impeller 131 and motor 134. The use of sound reflecting, sound dampening and/or sound absorbing materials (not shown), may be used to lower the perceivable noise of motor 134 and impeller 131 thereby further simulating the low noise characteristics of a conventional oil filled heater. In embodiments having a sound attenuation system, the sound reflecting, sound dampening and/or sound absorbing materials are preferably disposed over an inner surface of the sidewalls of housing 102.

Another advantage associated with the use of transfer duct 130 is the location of motor 134 and impeller 131 inside housing 102 is closer to a support surface. Locating the mass of both motor 134 and impeller 131 closer to a support surface allows the center of gravity of portable electric heater 100 to be lower and thus increases the overall stability of the device.

FIG. 5 is an exploded view of another exemplary embodiment of heater assembly 520 of portable electric heater 100. Rotatable plenum 522 is constructed of front portion 524 and rear portion 526. Motor 534 is connected to rear portion 526 of rotatable plenum 522 utilizing bracket 536. Impeller 531 is connected to motor 534 via socket 533 of impeller 531 and motor shaft 535. Impeller 531 is located between entry port 537 and first air passageway 538 both located in rear portion 526 of rotatable plenum 522. Second interior space 522*a* is located between first air passageway 538 and hot air exit 528. Heating element 140 is located in second interior space 522*a* of rotatable plenum 522 proximate hot air exit 528 located, as shown in this example, in front portion 524. In the non-limiting embodiment shown, impeller 531 is a cross flow type impeller. It is contemplated that a centrifugal type impeller could also be utilized without departing from the spirit of the invention.

Ambient air is drawn into entry port 537 by a rotation of impeller 531. Impeller 531 accelerates the ambient air and generates an exhaust air stream which passes through first air passageway 538 entering second interior space 522*a* of rotatable plenum 522. Second interior space 522*a* is charged with a positive static pressure causing the exhaust air stream to flow through substantially all of heating element 140. Thermal energy (heat) is transferred to substantially all of the exhaust air stream as it flows through heating element 140, thus becoming a heated exhaust air stream.

In the embodiment shown, air directing mechanism includes stem 527 connected to rotatable plenum 522 of heater assembly 520. Stem 527 passes through slot 106 (see FIG. 3) to be exposed exterior to housing 102. Slide 152 is connected to stem 527 and is utilized by the user of portable electric heater 100 to rotate rotatable plenum 522 about axis of rotation "Z". The rotatable movement of rotatable plenum 522 allows the user to change the vertical angular direction of the heated exhaust air stream. As shown, studs 580 and 582 are used as rotation points of rotational plenum 522 about axis of rotation "Z".

In addition, air directing mechanism can also include a mechanism for adjusting the flow of heated exhaust air from side to side (not shown), as well as, up and down. Also, air directing mechanism can include a gear and motor system and be controlled from control assembly 154 or remotely using remote control 156.

Although heater assembly 520 of FIG. 5 allows the user to change the direction of the heated exhaust air stream it does not have the sonic isolation enhancement opportunities when compared to embodiment of heater assembly 120 shown in FIG. 4. As can also be appreciated, the control wires of motor 534 of heater assembly 520 will be required to flex and move with rotatable plenum 522, whereas the control wires of motor 134 of heater assembly 120 shown in FIG. 4 does not have such requirements. The elimination of such flexing and movement of the wires reduces the possibility of loose connections and wire fatigue over time. The embodiment of FIG. 5 is similar to the embodiment of FIG. 4 in all other functional respects.

Referring now to both FIGS. 4 and 5, it is contemplated that heating element 140 may be omitted to permit both heater assembly 120 and 520 to be used as an air circulation devices. This would in turn convert the described portable electric heater 100 into an air circulator, fan, or cooling device. Although not specifically described, such an embodiment does not depart from the spirit of the invention. It is also contemplated that portable electric heater 100 may include the ability to bypass the use of heating element 140 and thus provide the dual use of a heater and an air circulation device.

Figure 6A:
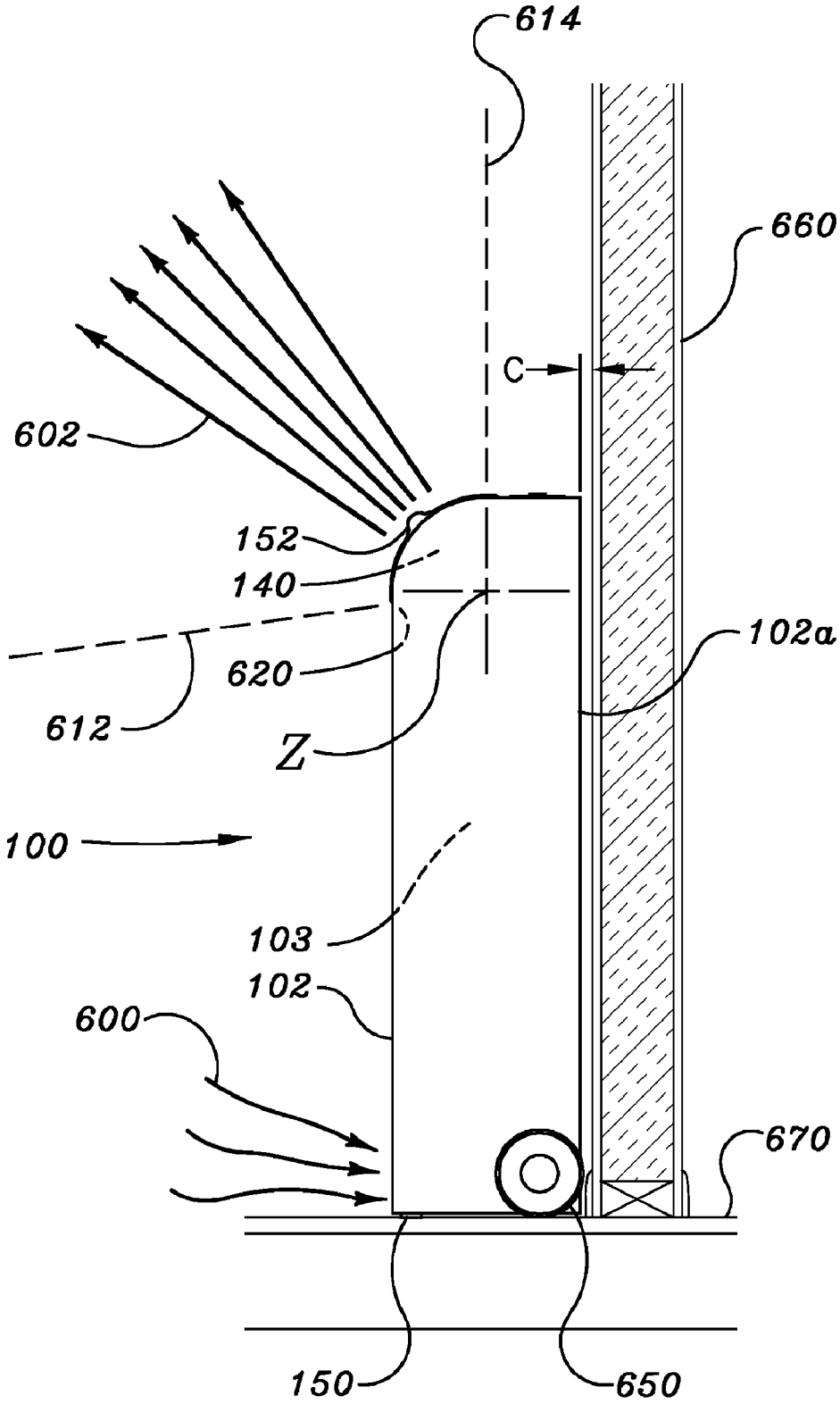
FIGS. 6A and 6B are side views of the embodiment of FIG. 1 illustrating the space saving characteristics of the portable electric heater and additional inventive features.

FIG. 6A is a side view of the portable electric heater 100 illustrating the space saving characteristics. As shown, portable electric heater 100 is position proximate wall 660. The substantially flat and planar surface of rear side 102*a* is oriented substantially orthogonal to floor 670 allowing portable electric heater 100 to be located in close proximity to other objects, such as wall 660. Although shown located near wall 660 portable electric heater may also be located near other vertically standing objects, such as for example, furniture. When referring to rear side 102*a*, close proximity signifies that the substantially flat surface allows the distance "C" as measured between rear side 102*a* and wall 660 to be less than about 50% of overall depth "D" of housing 102, (see FIGS. 2, 6A and 6B). In another embodiment distance "C" is less that about 2 inches.

As shown in FIG. 6A, ambient air 600 is drawn into housing 102 of portable electric heater 100 and exits as heated exhaust air stream 602. Slide 152 is used to rotate the discharge direction of heated exhaust air stream 602 about axis of rotation "Z". Heated exhaust air stream 602 can be discharged at any angle between upper limit 614 and lower limit 612. In one embodiment, upper limit 614 is substantially vertically upward and substantially parallel to the substantially flat and planar surface of rear side 102*a*. Upper limit 614 as described limits the ability of heated exhaust air stream 602 to be discharged directly toward wall 660. In a non-limiting fashion, lower limit 612 is substantially perpendicular to the substantially flat and planar surface of rear side 102*a*. In another non-limiting embodiment, lower limit 612 may be about 30 degree below perpendicular relative to the substantially flat and planar surface of rear side 102*a*.

Although not shown it is also contemplated that an oscillation mechanism, (not shown) may be used to automatically oscillate the discharge direction of heated exhaust air stream 602 between upper limit 614 and lower limit 612. It is contemplated that the oscillation mechanisms, (not shown) may include reversible motors, gears, links and the like which are well known to one skilled in the art.

Also shown in FIG. 6A are feet 150 and wheels 650. Wheels 650 may be used to increase the portability of portable electric heater 100.

As shown, the ability to draw ambient air 600 into a lower portion of the heater 100 and expel heated exhaust air stream 602 from a top portion of the heater 100 enhance the establishment of a circular air flow within a room. The circular, or cyclonic air flow within a room increases the uniform dispersal of heated exhaust air stream 602 throughout the room. The uniform dispersal reduces the possible existence of hot and cold spots within the room, increasing the overall comfort of the user.

In one embodiment, the discharge elevation of heated exhaust air stream 602 from housing 102 above floor 670 is greater than the overall width "W" of housing 102 or the overall depth "D" of housing 102 (see FIG. 2). In another embodiment, the discharge elevation of heated exhaust air stream 602 from housing 102 above floor 670 is greater than about 18 inches. The discharge elevation of heated exhaust air stream is defined by a distance measured from floor 670 to the highest point at which heated exhaust air stream 602 is capable of exiting housing 102.

The ability to locate portable electric heater 100 near wall 660 while limiting the ability of heated exhaust air stream 602 to be directed toward wall 660 has advantages over conventional heaters. For example, the radiation of heat in all directions that occurs from a conventional oil filled heater does not allow the conventional oil filled heater to be placed in close proximity to a wall of a room. The inability to place a heater next to a wall or other objects in the room reduces it's space saving characteristics. As can be appreciated portable electric heater 100 does not have such limitations.

Because of the portability of portable electric heater 100 it is possible that the user might inadvertently position the device so that heated exhaust air stream 602 is discharged toward wall 660. A sensing element, such as thermister 620 disposed within first interior space 103 and located proximate lower limit 612 of the discharge angle of heated exhaust air stream 602, can be included in portable electric heater 100 enhances the ability of portable electric heater 100 to detect this condition. It is contemplated that the sensing element can include other safety devices that automatically responds to temperature changes in lieu of thermister 620. Such alternate devices include, for example, bimetallic switches, solid state devices, optical sensors and the like.

For example, thermister 620 will detect the air temperature proximate lower limit 612. If heated exhaust air stream 602 is discharged toward wall 660 or the normal path of it's exit from first interior space 103 is impeded, the elevated temperature detected by thermister 620 can cause the flow of power to heating element 140 to be interrupted. As can be appreciated the function of thermister 620 will reduce possible damage caused by elevated air temperatures to the structure of portable electric heater 100 and/or to wall 660 and/or other objects near heated exhaust air stream 602.

Figure 6B:
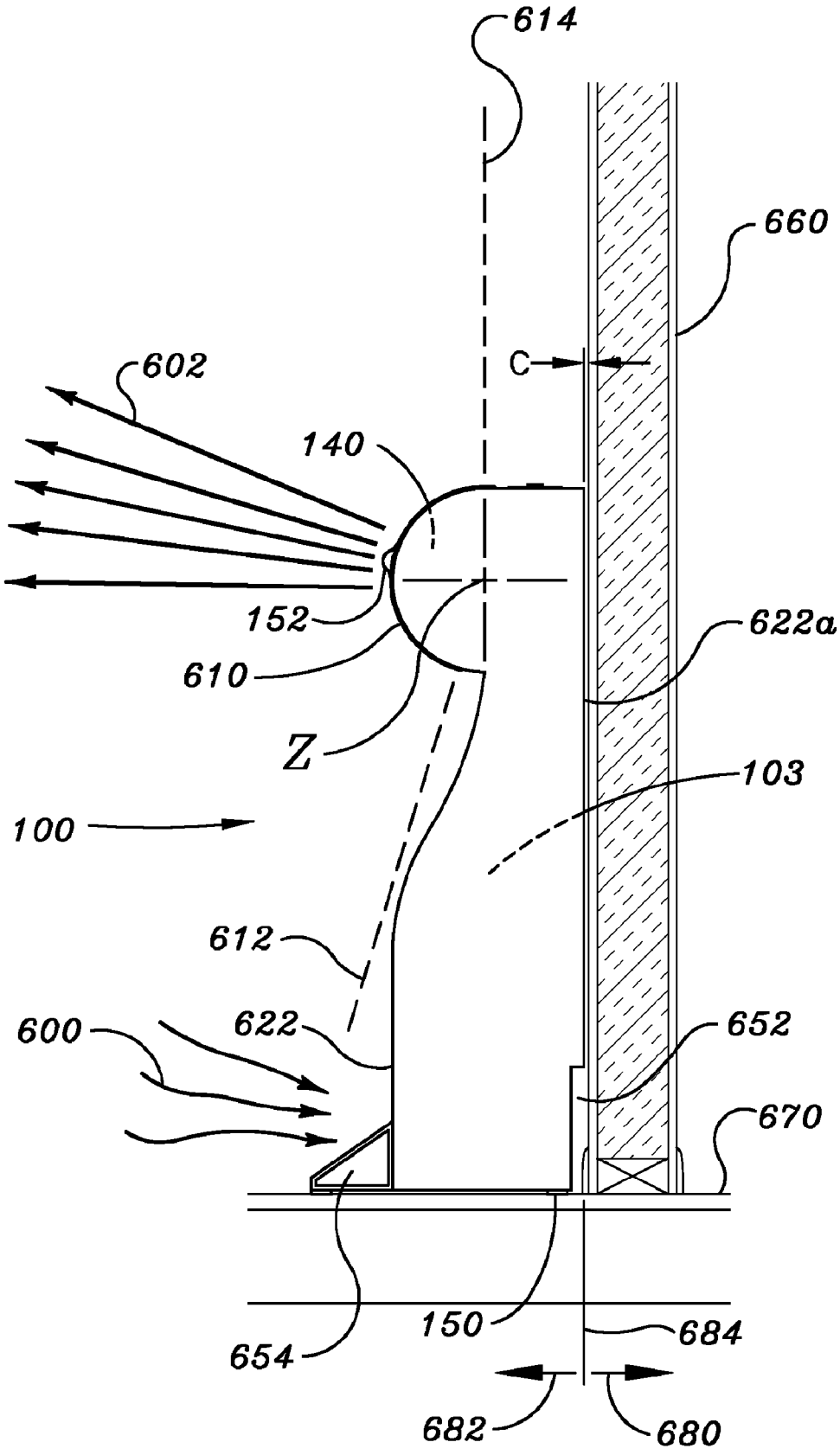

Similar to FIG. 6A, FIG. 6B is a side view another exemplary embodiment of portable electric heater 100. As shown, housing 622 includes notch 652 in rear side 622*a*. Notch 652 provides a clearance for the baseboard along wall 660 thus allowing to distance "C" to be further minimized. Also shown is extension 654. Extension 654 increases the base depth of portable electric heater 100 without increasing overall depth "D" of housing 622. This feature increases the stability of portable electric heater 100 without severely compromising space saving characteristics.

The extended curved surface of outlet grill 610 increases the angular range of discharge of heated exhaust air stream 602 by increasing the angular relationship between lower limit 612 and upper limit 614. This greatly increases angular range of adjustability for the discharge of heated exhaust air stream 602 when compared to the embodiment of FIG. 6A. In one embodiment, lower limit 612 is substantially vertically downward and substantially parallel to the substantially flat and planar surface of rear side 622*a*.

Limiting upper limit 614 to substantially vertically upward and limiting lower limit 612 to substantially vertically downward creates a temperature boundary 684 that extends outward and is substantially coplanar with the substantially flat and planar surface of rear side 622*a*. This results in a cold side 680 and hot side 682 on opposite sides of temperature boundary 684. Cold side 680 facilitates the ability to locate portable electric heater 100 proximate other objects and increases the space saving characteristics of the device. Heated exhaust air stream 602 can only be discharged on hot side 682 in a substantially forward direction between lower limit 612 and upper limit 614.

Figure 7B:
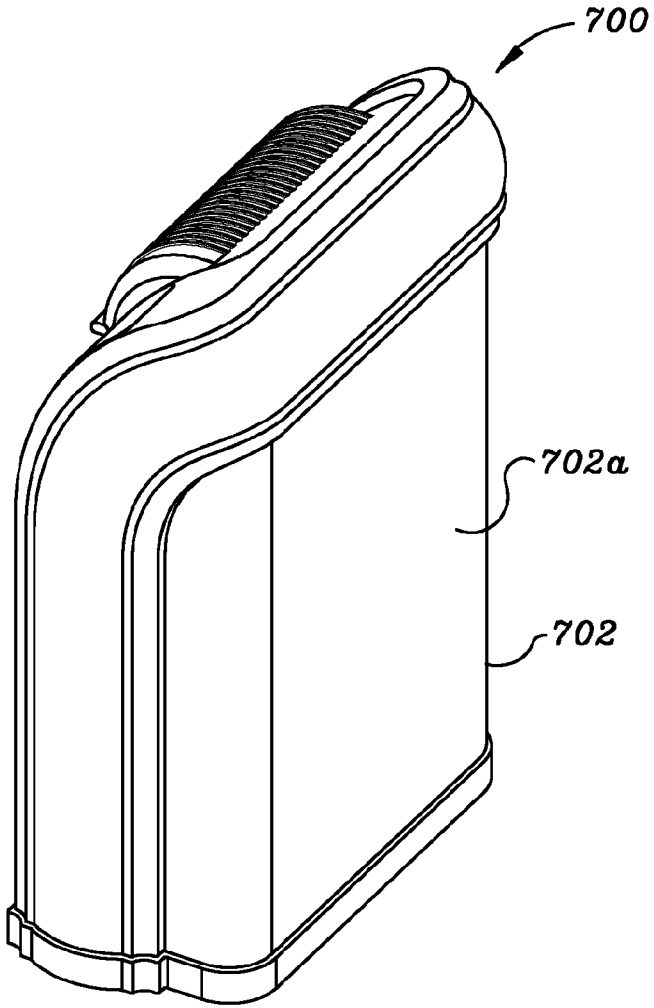
FIGS. 7A and 7B show an alternative embodiment of the invention.
Figure 7A:
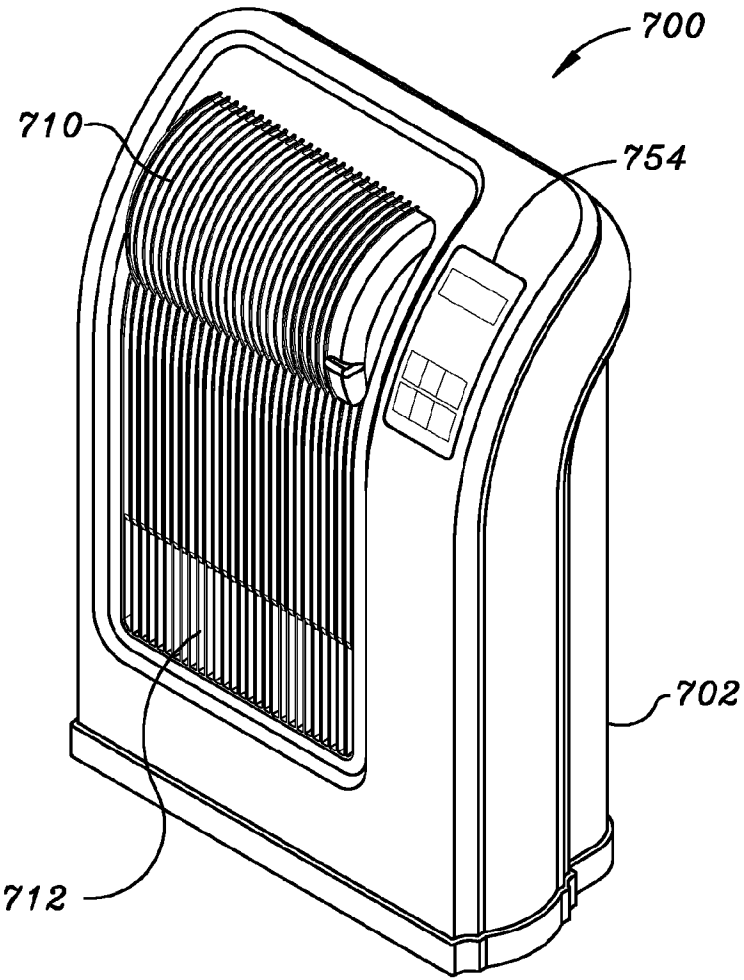

FIG. 7A is a front perspective view of an alternative embodiment of portable electric heater 700 of the present invention. FIG. 7A shows inlet grill 712 located in a lower portion of housing 702 and outlet grill 710 located in an upper portion of housing 702. Also shown is control assembly 754 located in an upper portion of housing 702. FIG. 7B is a rear perspective view of the portable electric heater 700 of FIG. 7A. As shown in FIG. 7B, rear side 702*a* may be substantially flat and planar and may be oriented substantially orthogonal to a support surface (e.g., a floor). As can be appreciated, although the aesthetic shape of housing 702 has been modified inventive features previously described are present within these embodiments.

Figure 8B:
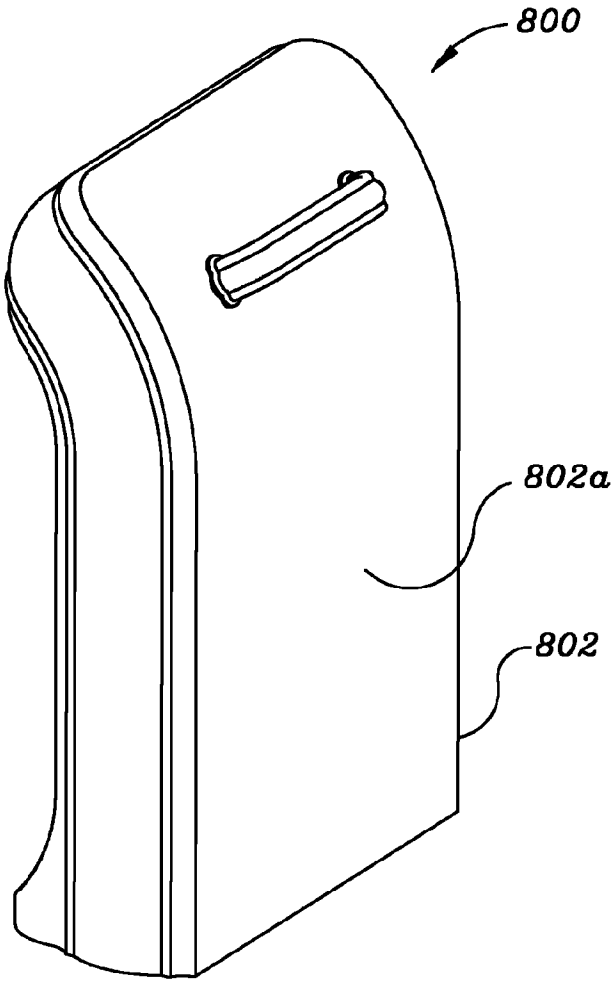
FIGS. 8A and 8B show yet another embodiment of the invention.
Figure 8A:
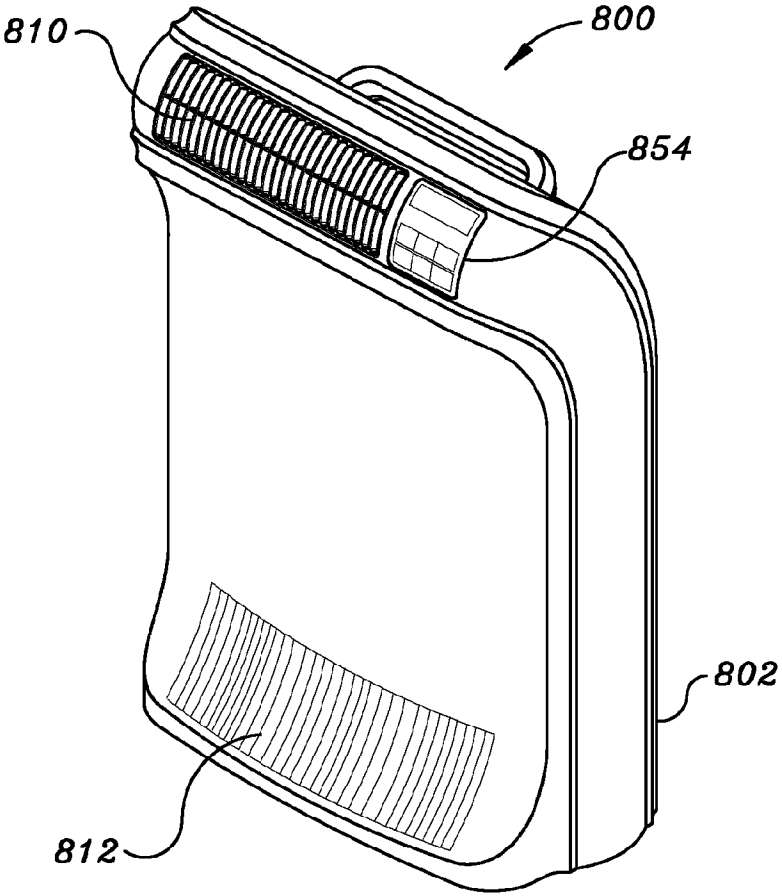

FIG. 8A is a front perspective view of yet another exemplary embodiment of portable electric heater 800. FIG. 8A shows inlet grill 812 located in a lower portion of housing 802 and outlet grill 810 located in an upper portion of housing 802. Also shown is control assembly 854 located in an upper portion of housing 802. FIG. 8B is a rear perspective view of the portable electric heater 800 of FIG. 8A. As shown in FIG. 8B, rear side 802*a* may be substantially flat and planar and may be oriented substantially orthogonal to a support surface (e.g., a floor). Similar to the embodiment of FIG. 7A, the aesthetic shape of housing 802 has been modified. It is contemplated that a variety of aesthetic modifications can be implemented without departing from the spirit of the invention.

As described the ability of portable electric heater 100 to direct heated exhaust air stream 602 overcomes the heat radiation problems associated with oil filled heaters, thus enhancing it's space saving characteristics. Limiting the angular direction of discharge of heated exhaust air stream 602 helps establish a distinct cold side 680 and distinct hot side 682 further enhancing the ability to locate portable electric heater 100 next to other object such as, for example a wall or furniture. This ability further enhances space saving characteristics. The elevation of air outlet 116 also serves to overcome the deficiencies found in the conventional electric baseboard heater.

Locating motor 134 and impeller 131 within housing 102 away from air inlet 114 and outlet grill 110 enhances possible sonic isolation of impeller 131 and motor 134 further simulating the low noise characteristics associated with a conventional oil filled heater. The use of electronics to control heating element 140 and/or the rotational speed of impeller 131 can be used to provide a consistent and stable heat output from portable electric heater 100.

Portable electric heater 100, as described, has the ability to simulate the desirable functions of the an oil filled heater without the use of oil thus avoiding the manufacturing and environmental problems associated with conventional portable oil filled heaters.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A portable electric heater comprising:

a housing;

a substantially planar rear surface of said housing oriented substantially vertical relative to a horizontal support surface;

a first interior space defined by said housing;

an air inlet in said housing allowing air to enter said first interior space;

an air outlet in an upper portion of said housing;

a motor disposed within said first interior space, said motor having a shaft;

an air impeller disposed within said first interior space and connected to said shaft of said motor, said air impeller in fluid communication with said air inlet and said air outlet;

an exhaust air stream generated by a rotation of said air impeller;

a second interior space disposed within said first interior space positioned between and in fluid communication with said air impeller and said air outlet, wherein said second interior space receives said exhaust air stream and prevents a substantial fluid communication of said exhaust air stream with said first interior space, said second interior space comprising:

a rotatable plenum comprising;

a side wall;

a hot air exit in said side wall;

a substantially horizontal axis of rotation about which said rotatable plenum rotates;

an upper limit and a lower limit of rotation of said rotatable plenum;

an electric heating element located proximate said hot air exit of said rotatable plenum; and a heated exhaust air stream formed by passing said exhaust air stream exiting said second interior space through said electric heating element, said heated exhaust air stream subsequently exiting said housing through said air outlet;

wherein a direction of discharge of said heated exhaust air stream is adjusted vertically up and down relative to said horizontal support surface as said rotatable plenum rotates about said substantially horizontal axis of rotation between said upper limit and said lower limit.

2. The portable electric heater of claim 1, wherein said rotatable plenum further comprises:

a first end wall;

a second end wall opposite said first side wall;

a horizontal distance between said first end wall and said second end wall;

said side wall extending between said first end wall and said second end wall.

3. The portable electric heater of claim 2, wherein said exhaust air stream enters said rotatable plenum through one of: said first end wall; or said second end wall.

4. The portable electric heater of claim 2, wherein said at least one hot air exit further comprises an elongate hot air exit having a longitudinal length oriented horizontally.

5. The portable electric heater of claim 4, wherein said electric heating element further comprises an elongate electric heating element having a longitudinal length oriented horizontally and aligned with said elongate hot air exit, and wherein said elongate electric heating element is connected to and rotates with said rotatable plenum.

6. The portable electric heater of claim 5, wherein said air impeller further comprises an elongate air impeller having a longitudinal length oriented horizontally, and wherein said elongate air impeller is substantially align with said elongate rotatable plenum, said elongate hot air exit, and said elongate electric heating element.

7. The portable electric heater of claim 4, further comprising an air directing component disposed within said rotatable plenum, wherein said air directing component distributes the flow of said exhaust air stream in a substantially even fashion over the longitudinal length of said hot air exit.

8. The portable electric heater of claim 2, wherein said first end wall and said second end wall are rounded in form and said side wall is cylindrical in form, said rotatable plenum comprising a drum-shaped plenum.

9. The portable electric heater of claim 1, wherein said motor is substantially stationary relative to said horizontal support surface during a rotation of said rotatable plenum.

10. The portable electric heater of claim 9, wherein said second interior space further comprises a transfer duct between said at least one air impeller and said rotatable plenum, wherein said transfer duct is stationary and does not move relative to said horizontal support surface during a rotation of said rotatable plenum.

11. The portable electric heater of claim 1, wherein said motor moves relative to said horizontal support surface during a rotation of said rotatable plenum.

12. The portable electric heater of claim 1, wherein said rotatable plenum further comprises an extension extending through an opening in said housing, said extension utilized to rotate said rotatable plenum between said upper limit and said lower limit of rotation.

13. The portable electric heater of claim 1, wherein said electric heating element moves in conjunction with said rotatable plenum during a rotation of said rotatable plenum.

14. The portable electric heater of claim 1, wherein said substantially planar rear surface of said housing is stationary and does not move relative to said horizontal support surface during a rotation of said rotatable plenum.

15. A portable electric heater comprising:

a housing comprising;

a rear wall having at least one substantially planar surface oriented substantially perpendicular to said horizontal support surface;

a front wall substantially parallel to said rear wall;

a bottom wall extending between said rear wall and said front wall;

a pair of side walls extending between said rear wall and said front;

a top wall extending between said rear wall and said front wall;

a curved surface located between said front wall and said top wall;

a first interior space defined by said housing;

an air inlet in a lower portion of said housing allowing air to enter said first interior space;

an air outlet located in said curved surface of said housing;

a motor disposed within said first interior space, said motor having a shaft;

an air impeller connected to said shaft of said motor, said air impeller in fluid communication with said air inlet and said air outlet;

an exhaust air stream generated by a rotation of said air impeller;

a second interior space disposed within said first interior space positioned between and in fluid communication with said air impeller and said air outlet, wherein said second interior space receives said exhaust air stream and prevents a substantial fluid communication of said exhaust air stream with said first interior space, said second interior space comprising:

a rotatable plenum comprising;

a first end wall;

a second end wall;

a horizontal distance between said first end wall and said second end wall;

a side wall extending between said first end wall and said second end wall;

at least one hot air exit in said side wall;

a substantially horizontal axis of rotation about which said rotatable plenum rotates;

an electric heating element located proximate said hot air exit of said rotatable plenum; and a heated exhaust air stream formed by passing said exhaust air stream exiting said second interior space through said electric heating element, said heated exhaust air stream subsequently exiting said housing through said air outlet;

wherein a direction of discharge of said heated exhaust air stream is adjusted vertically up and down relative to said horizontal support surface as said rotatable plenum rotates about said substantially horizontal axis of rotation.

16. The portable electric heater of claim 15, wherein said first and second end walls of said plenum further comprise circular end walls and a radius of said circular end walls conforms to a radius of said curved surface of said housing.

17. The portable electric heater of claim 16, wherein said rotatable plenum is located adjacent said curved surface of said housing and said hot air exit is located proximate said air outlet of said housing.

18. A portable electric heater comprising:

a housing extending vertically upward from a horizontal support surface, said housing comprising:

a rear wall having a substantially planar surface oriented substantially perpendicular to said horizontal support surface;

a front wall substantially parallel to said rear wall;

a bottom wall extending between said rear wall and said front wall;

a pair of side walls extending between said rear wall and said front wall;

a top wall extending between said rear wall and said front wall;

a first interior space defined by said housing;

an air inlet located in a lower portion of said housing allowing air to enter said first interior space;

an air outlet located in an upper portion of said housing allowing air to exit said housing;

a blower assembly disposed within said first interior space comprising:

an entry port;

an air passageway;

a motor comprising a shaft;

an air impeller connected to said shaft of said motor and disposed between said entry port and said air passageway;

a first fluid connection between said air inlet located in said lower portion of said housing and said entry port of said blower assembly;

a second interior space defined by a self-contained plenum separate and distinct from said first interior space, said plenum disposed within said first interior space and positioned between said air impeller and said air outlet;

a second fluid connection between said air passageway of said blower assembly and said second interior space;

a hot air exit in said plenum of said second interior space and located proximate said air outlet of said housing, wherein said hot air exit allows air to exit said second interior space;

a third fluid connection between said hot air exit of said second interior space and said air outlet located in said upper portion of said housing;

an electric heating element located proximate said hot air exit of said second interior space;

an air flow path through said portable electric heater defined by said first, said second, and said third fluid connections in sequential order fluidly connecting said air inlet, said air impeller, said electric heating element, and said air outlet;

a heated exhaust air stream exiting said air outlet, wherein said heated exhaust air stream is generated by a rotation of said air impeller causing air to be discharged from said air impeller into said plenum and subsequently flowing through said electric heating element, wherein said second interior space prevents a substantial fluid communication between said air discharged from said air impeller and said first interior space;

a direction of discharge of said heated exhaust air stream that is adjustable vertically up and down relative to said horizontal support surface; and an upper limit and a lower limit of the adjustment of said direction of discharge of said heated exhaust air stream; wherein said substantially planar surface of said at least one rear wall of said housing does not move relative to an adjustment of said direction of discharge of said heated exhaust air stream;

wherein said direction of discharge of said heated exhaust air stream at said upper limit and said lower limit is one of i) parallel to said substantially planar surface of said rear wall, or ii) angled relative to said planar surface of said rear wall in a forward direction, and;

wherein said upper limit and said lower limit establish a temperature boundary formed vertically along an imaginary plane extending out from and oriented substantially coplanar with said substantially planar surface of said rear wall and said temperature boundary impedes a substantially direct impingement of said heated exhaust air stream on other objects located rearward of said substantially planar surface of said rear wall.

19. The portable electric heater of claim 18, further comprising a curved surface located between said front wall and said top wall, wherein said air outlet is located completely in said curved surface.

* * * * *